US009773628B2

(12) United States Patent
Fukuyama et al.

(10) Patent No.: US 9,773,628 B2
(45) Date of Patent: Sep. 26, 2017

(54) BREAKER

(71) Applicant: TOYODA GOSEI CO., LTD., Kiyosu-shi, Aichi-ken (JP)

(72) Inventors: Takaki Fukuyama, Kiyosu (JP); Yoshiki Nakamura, Kiyosu (JP); Keisuke Hori, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 15/070,518

(22) Filed: Mar. 15, 2016

(65) Prior Publication Data

US 2016/0293362 A1 Oct. 6, 2016

(30) Foreign Application Priority Data

Mar. 30, 2015 (JP) ..... 2015-069092

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... H01H 33/06; H01H 33/42; H01H 33/22; H01H 33/72; H01H 33/74; H01H 39/006; H01H 39/00; H01H 9/443
USPC ..... 218/154, 95; 200/61.08; 337/130, 157, 337/401
See application file for complete search history.

(56) References Cited

U.S. PATENT DOCUMENTS 6,222,439 B1 * 4/2001 Tanigawa ..... H01H 39/006 337/401
7,222,561 B2 * 5/2007 Brede ..... B23D 15/145 83/639.4
7,745,745 B2 * 6/2010 Kordel ..... B23D 15/145 200/61.08
8,432,246 B2 * 4/2013 Suzuki ..... H01H 9/12 337/157
2007/0034491 A1 2/2007 Knauss et al.
2013/0175144 A1 * 7/2013 Sprenger ..... B23D 15/145 200/61.08
2014/0061161 A1 3/2014 Nakamura et al.

FOREIGN PATENT DOCUMENTS

JP 2009-174846 A 8/2009

OTHER PUBLICATIONS

Translation JP2009174846 (Original Doc published Jun. 8, 2009).*

* cited by examiner

*Primary Examiner* — Renee S Luebke
*Assistant Examiner* — William Bolton
(74) *Attorney, Agent, or Firm* — Posz Law Group, PLC

(57) ABSTRACT

A breaker includes conductors, each including an elongated flat cut portion, cutting chambers arranged in correspondence with the cut portions, a single cutting member that includes blades to cut the cut portions in the cutting chambers, a gas generator that generates gas to move the cutting member toward the cut portions, and an arc attenuation portion located between the two cut portions that are adjacent to each other. The conductors are located between two devices. Each cut portion is cut to form two separated cutting ends and electrically disconnect the devices. The arc attenuation portion attenuates an arc generated between the two cutting ends of one of the two adjacent cut portions and the two cutting ends of the other cut portion.

7 Claims, 7 Drawing Sheets

BREAKER

TECHNICAL FIELD

The present invention relates to a breaker that cuts a conductor extending between two devices in an electric circuit to electrically disconnect the two devices.

BACKGROUND OF THE INVENTION

An electric circuit includes a breaker that functions when an abnormality occurs in a device of the electric circuit or when an abnormality occurs in a system including the electric circuit to electrically disconnect devices in the electrical circuit. In one type of such a breaker, two conductors, each including an elongated flat cut portion, are arranged between devices of an electric circuit. The breaker cuts each conductor at the cut portion to form two cutting ends that are separated from each other. This electrically disconnects the devices. However, a potential difference produced between the two cutting ends of one of the cut portions and the two cutting ends of the other cut portion may generate an arc.

Japanese Laid-Open Patent Publication No. 2009-174846 discloses an example of a breaker that attenuates arcs by locating the two cut portions away from each other. The breaker includes the two cut portions, which are flat and opposed to each other in the thickness-wise direction, and a single gas generator, which is arranged between the two cut portions. Two cutting members are each arranged between the gas generator and one of the cut portions. Each of the cutting members includes a blade, which projects toward the corresponding cut portion. The gas generated from the gas generator moves the two cutting members away from each other in opposite directions, and the blade of each cutting member cuts the corresponding cut portion.

SUMMARY OF THE INVENTION

In the breaker of Japanese Laid-Open Patent Publication No. 2009-174846, the two cutting members are located between the two cut portions that are separated from each other in the thickness-wise direction. Each cutting member moves toward the corresponding cut portion. This attenuates arcs generated between the cut portions that are adjacent to each other but enlarges the breaker in the direction the two cut portions are opposed to each other.

It is an object of the present invention to provide a smaller breaker that attenuates arcs generated between two adjacent cut portions.

A breaker that solves the above problem includes a plurality of conductors, each including an elongated flat cut portion, cutting chambers respectively arranged in correspondence with the cut portions, a gas generator located at a side of the cut portions opposite to the cutting chambers, a single cutting member located between the cut portions and the gas generator, and an arc attenuation portion located between the two cut portions that are adjacent to each other. The cutting chambers are each located at one side of the corresponding cut portion in a thickness-wise direction of the cut portion. Each of the cut portions is cut to form two separated cutting ends and electrically disconnect the devices. The conductors are located between the devices. The cut portions are aligned in a widthwise direction of the cut portions. The cutting member includes blades, the number of which is the same as the cut portions, and the gas generator generates gas that moves the cutting member to cut the cut portions with the blades in the cutting chambers. The arc attenuation portion is formed from an electrically insulative material, and the arc attenuation portion attenuates an arc generated between the two cutting ends of one of the two adjacent cut portions and the two cutting ends of the other cut portion.

In the above structure, before the gas generator generates gas, each blade of the cutting member is located between the cut portion of the corresponding conductor and the gas generator and separated from the corresponding cutting chamber. Thus, the cut portions are not cut so that the two devices of the electric circuit are electrically connected by all the conductors.

In contrast, when gas is generated from the gas generator with all the conductors electrically connected, the gas moves the cutting member toward the cutting chambers. Each cut portion is pressed by the corresponding blade of the cutting member and cut in the corresponding cutting chamber. When each cut portion is cut, two cutting ends separated from each other are formed at each cut portion. Each conductor is divided at the two cutting ends to electrically disconnect the devices.

An arc may be generated between the two cutting ends of one of the two adjacent cut portions and the two cutting ends of the other one of the two adjacent cut portions. However, the arc is attenuated by the arc attenuation portion arranged between the adjacent cut portions. Thus, the arc has a smaller influence on the breaker than a breaker that does not includes the arc attenuation portion.

When the single cutting member is moved toward the cutting chambers, the cut portions aligned in the widthwise direction of the cut portions are cut by the blades, the number of which is the same as the cut portions. That is, when the blades are moved in the same direction, the cut portions are cut. Thus, the breaker is reduced in size in the movement direction of the cutting member compared to a breaker that moves the two cutting members in opposite directions between the two cut portions opposed in the thickness-wise direction.

EMBODIMENTS OF THE INVENTION

First Embodiment

A breaker C according to a first embodiment of the present invention will now be described with reference to FIGS. 1 to 7.

Figure 2:
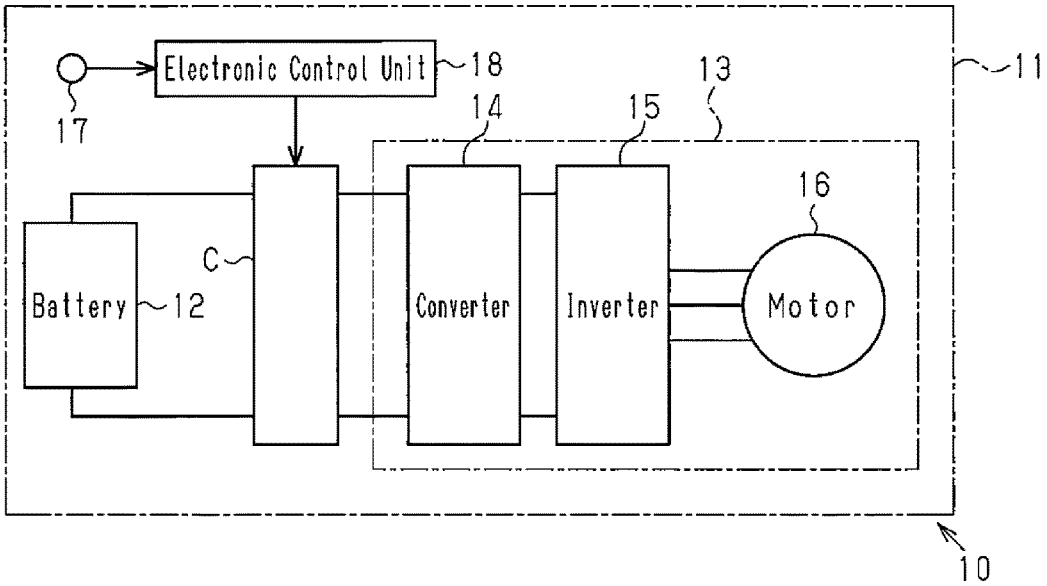
FIG. 2 is a schematic diagram showing an electric circuit to which the breaker of FIG. 1 is applied.

FIG. 2 shows an electric circuit 11, to which the breaker C is applied. The electric circuit 11 includes a battery 12 and an electric device 13. In the electric circuit 11, the battery 12 supplies power to activate the electric device 13. The electric device 13 includes a converter 14, an inverter 15, and a motor 16. The converter 14 boosts the voltage of power that is received from the battery 12 and outputs the power. The inverter 15 converts DC power, which is received from the converter 14, into AC power, which is suitable for driving a motor, and outputs the power. The motor 16 is driven by the AC power that is output from the inverter 15.

The electric circuit 11 is installed in a vehicle 10. When an impact is applied to the vehicle 10 during a collision, the electric device 13 may not function properly, and current may leak from the electric circuit 11. Thus, the vehicle 10 includes the breaker C, which electrically disconnects the devices of the electric circuit 11 (for example, battery 12 and electric device 13), when such a collision occurs. The vehicle 10 includes a collision sensor 17 and an electronic control unit 18. The collision sensor 17 detects a collision and generates an output signal indicating the collision. The electronic control unit 18, which includes a microcomputer, receives the output signal from the collision sensor 17. When the electronic control unit 18 detects the collision of the vehicle 10 from the output signal of the collision sensor 17, the electronic control unit 18 activates the breaker C. This stops the supply of power from the battery 12 to the electric device 13.

Figure 1:
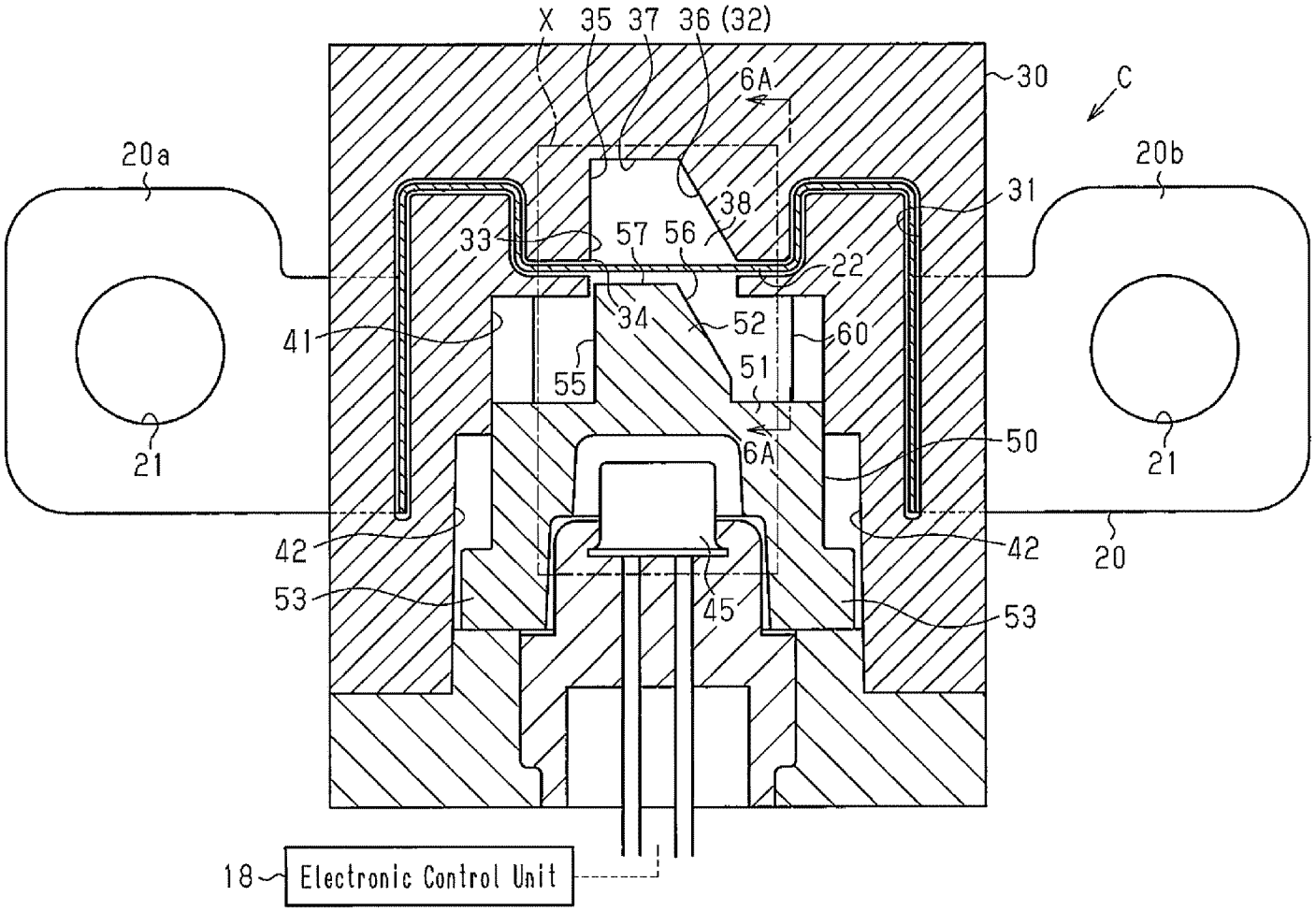
FIG. 1 is a cross-sectional view showing the internal structure of a first embodiment of a breaker.
Figure 5:
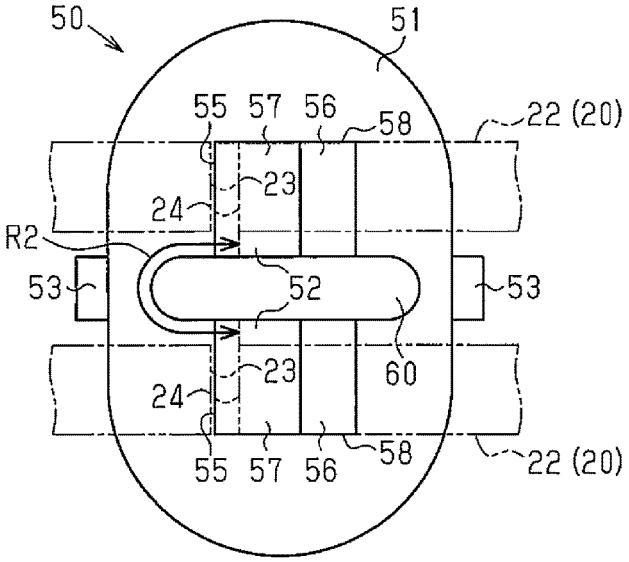
FIG. 5 is a plan view showing the relationship of a cutting member and two cut portions in the breaker of FIG. 1.

As shown in FIGS. 1 and 5, the breaker C includes two conductors 20, a case 30, a propellant-type gas generator 45, and a single cutting member 50. Each component of the breaker C will now be described.

Two Conductors 20

Each conductor 20, which is also referred to as a bus bar, forms a line that electrically connects the battery 12 and the converter 14. The two conductors 20 have the same structure. Each conductor 20 is flat and formed from a metal material having high electrical conductivity such as copper. Instead of copper, each conductor 20 may be formed from another material such as brass or aluminum.

Each conductor 20 includes two ends defining external connection portions 20*a* and 20*b*, which are connected to the battery 12 and the converter 14. A through hole 21 extends through each of the external connection portions 20*a* and 20*b*. A fastener such as a screw is inserted into each through hole 21 to connect one of the external connection portions 20*a* and 20*b* to a terminal that is electrically connected to the battery 12 and the other one of the external connection portions 20*a* and 20*b* to a terminal that is electrically connected to the converter 14. In this manner, the external connection portions 20*a* and 20*b* of the two conductors 20 are respectively connected to the two terminals of the battery 12 and the converter 14 in the electric circuit 11. Thus, the conductors 20 electrically connect the battery 12 and the converter 14.

Each conductor 20 includes a cut portion 22, which is located between the external connection portions 20*a* and 20*b*. Each cut portion 22 extends between the external connection portions 20*a* and 20*b* in the direction the external connection portions 20*a* and 20*b* are laid out (lateral direction in FIGS. 1 and 5). Each cut portion 22 has a fixed width. The direction in which the cut portions 22 extend, that is, the layout direction of the external connection portions 20*a* and 20*b*, is referred to as the longitudinal direction of the cut portions 22. The thickness-wise direction (vertical direction in FIG. 1) of the cut portions 22 refers to the thickness-wise direction of the cut portions 22 prior to cutting.

As shown in FIG. 5, the two conductors 20 are arranged so that the corresponding cut portions 22 are coplanar and parallel to each other in the widthwise direction of the cut portions 22.

Case 30

Figure 6A:
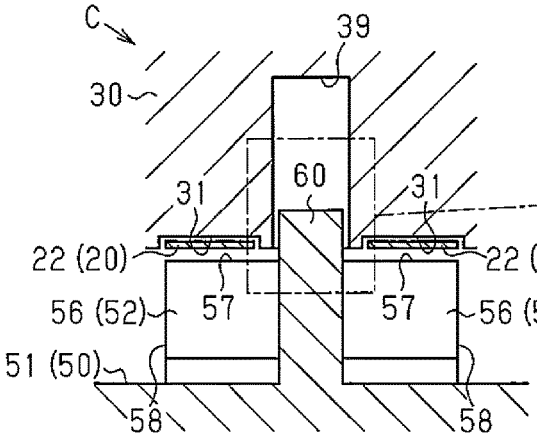
FIG. 6A is a cross-sectional view taken along line 6A-6A in FIG. 1.
Figure 6B:
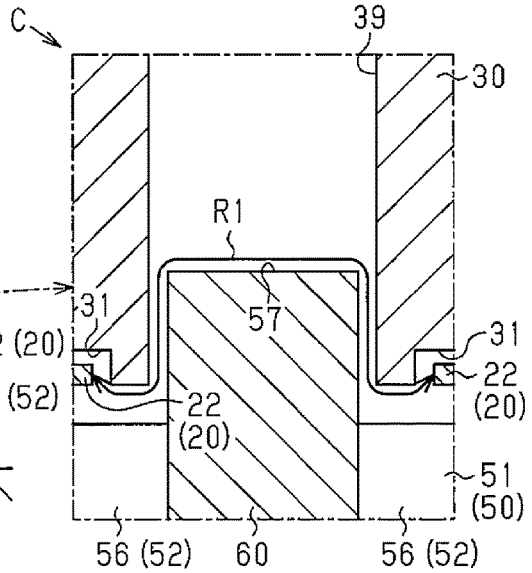
FIG. 6B is a partially enlarged cross-sectional view of FIG. 6A.

The case 30 is electrically insulative and formed from a material having high strength, for example, a resin material. As shown in FIGS. 1, 6A, and 6B, the case 30 includes two accommodation portions 31 to accommodate the two conductors 20. Each conductor 20 is accommodated in the corresponding accommodation portion 31 so that the external connection portions 20*a* and 20*b* extend out of the case 30. Two cutting chambers 32, which respectively correspond to the two cut portions 22, and a single recess 39, which is shared by the two cut portions 22, are defined in the case 30 at one thickness-wise side (upper side in FIG. 1) of the cut portions 22. A single guide chamber 41, which is shared by the two cut portions 22, is defined in the case 30 at the other thickness-wise side (lower side in FIG. 1) of the cut portions 22. That is, the guide chamber 41 is located at a side of the cut portions 22 opposite to the cutting chambers 32 and the recess 39.

In each cutting chamber 32, the cutting member 50 cuts each cut portion 22. Each cutting chamber 32 attenuates arcs generated between two cutting ends 23 and 24 (refer to FIG. 4), which are formed when each cut portion 22 is cut. Each cutting chamber 32 is set to have a width (in direction orthogonal to plane of FIG. 1) that is slightly larger than the width of the cut portions 22 so that the corresponding cut portions 22, subsequent to cutting, enters the cutting chamber 32.

Figure 3:
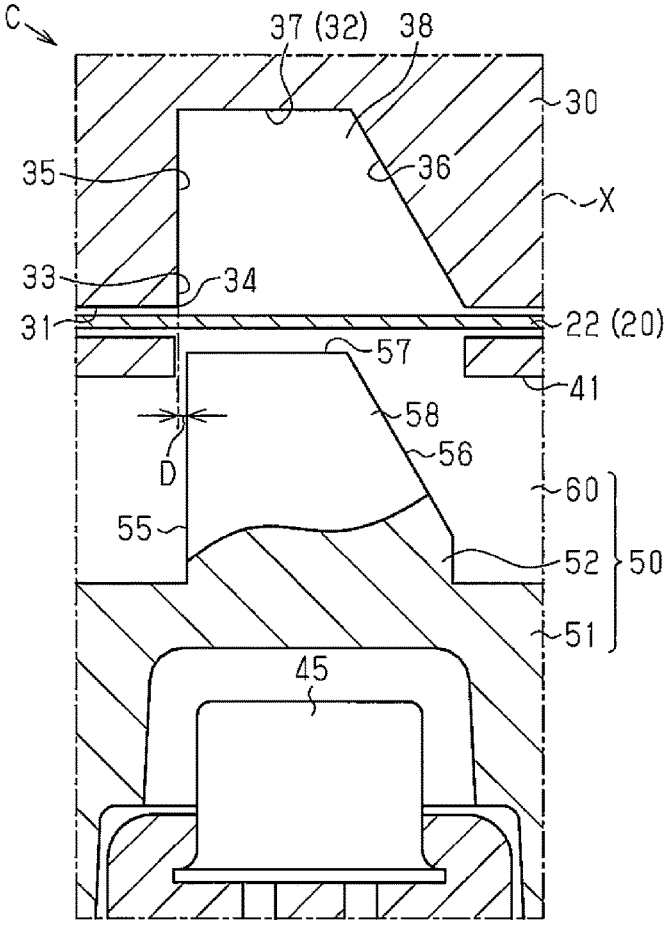
FIG. 3 is a partially enlarged cross-sectional view of section X shown in FIG. 1.

Referring to FIG. 3, each cutting chamber 32 includes a tetragonal opening 33, which faces the corresponding cut portion 22 prior to cutting. One longitudinal side (left side in FIG. 3) of the cutting chamber 32 serves as a cutting edge 34.

Each cutting chamber 32 includes inner walls. More specifically, each cutting chamber 32 includes a first inner wall 35, a second inner wall 36, a third inner wall 37, and two fourth inner walls 38. The first inner wall 35 includes the cutting edge 34 and extends in the direction orthogonal or substantially orthogonal to the cut portion 22. The second inner wall 36 is separated from the first inner wall 35 in the longitudinal direction of the cut portion 22. The second inner wall 36 is inclined relative to the first inner wall 35 so that the first inner wall 35 becomes closer to the second inner wall 36 as the opening 33 becomes farther. The third inner wall 37 is farthest from the opening 33 and parallel to or substantially parallel to the cut portion 22 prior to cutting. The fourth inner walls 38 are opposed to each other in the widthwise direction of the cut portions 22.

As shown in FIGS. 6A and 6B, an arc attenuation portion 60, which will be described below, enters the recess 39 as the cutting member 50 moves. The recess 39 is located between the two cutting chambers 32 and is communication with the cutting chambers 32 in the widthwise direction of the cut portions 22. The recess 39 extends in the thickness-wise direction of the cut portions 22. One end of the recess 39 (lower end in FIG. 6A) faces the guide chamber 41.

As shown in FIG. 1, the guide chamber 41 is hollow and extends in the thickness-wise direction of the cut portions 22. The inner wall of the guide chamber 41 includes guide grooves 42, which extend in the thickness-wise direction of the cut portions 22.

Gas Generator 45

The gas generator 45 is used as a drive source of the breaker C. The gas generator 45 is arranged in the case 30 and partially extends into the guide chamber 41. That is, the gas generator 45 is located at a side of the two cut portions 22 opposite to the cutting chambers 32 and the recess 39. The gas generator 45 is connected to the electronic control unit 18. When receiving an activation signal from the electronic control unit 18, the gas generator 45 ignites and burns the incorporated propellant to generate gas G (refer to FIG. 4).

In general, a device driven by the propellant-type gas generator 45 is more quickly driven, less expensive, and more reliable than devices driven by other power sources (for example, electromagnetic devices).

Cutting Member 50

Figure 7:
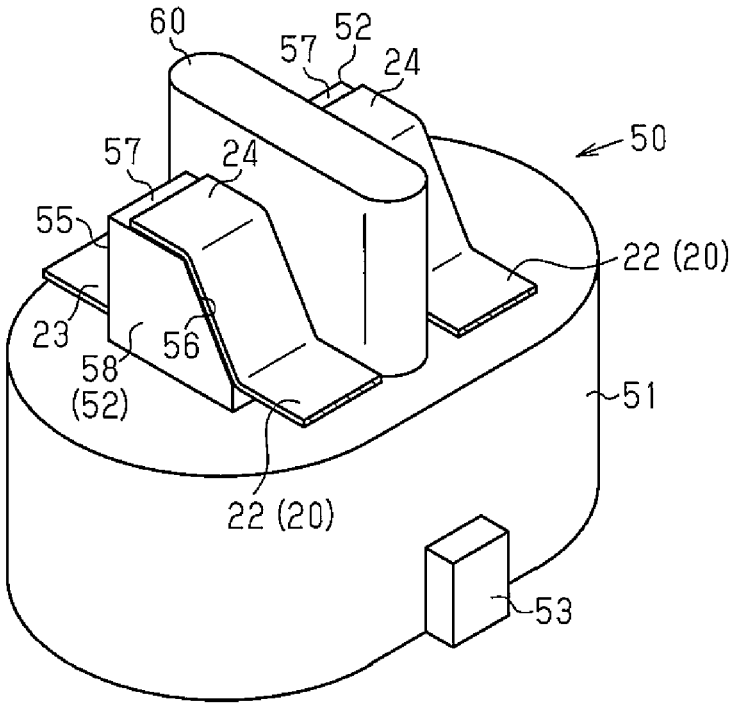
FIG. 7 is a partial perspective view showing the cutting member having two blades and the two cut portions that are cut by the two blades.

As shown in FIGS. 1 and 7, the cutting member 50 is in the guide chamber 41 between the cut portions 22 and the gas generator 45. The cutting member 50 includes a single body 51, two blades 52, which correspond to the two cut portions 22, and the arc attenuation portion 60. The cutting member 50 includes the same number of blades 52 as the cut portions 22.

Guide projections 53 project from the outer wall of the body 51. The guide projections 53 of the body 51 are engaged with the guide grooves 42 of the guide chamber 41 so that the body 51 is engaged with the guide chamber 41 and movable in the thickness-wise direction of the cut portions 22.

The blades 52 cut the cut portions 22 in cooperation with the cutting edges 34 of the corresponding cutting chambers 32. The two blades 52 have the same structure. The two blades 52 project toward the two corresponding cutting chambers 32 from two locations on the body 51 that are separated from each other in the widthwise direction of the cut portions 22.

As shown in FIGS. 3 and 7, each blade 52 includes outer walls. More specifically, each blade 52 includes a first outer wall 55, a second outer wall 56, a third outer wall 57, and a fourth outer wall 58. The first outer wall 55 extends in the direction orthogonal or substantially orthogonal to the corresponding cut portion 22 prior to cutting at a location separated from the cutting edge 34 of the corresponding cutting chamber 32 by a slight distance D (for example, approximately 0.5 mm), which is suitable for cutting (shearing) the cut portion 22 in cooperation with the cutting edge 34. The second outer wall 56 is arranged at a location separated from the first outer wall 55 in the longitudinal direction of the cut portion 22. The second outer wall 56 is inclined in correspondence with the second inner wall 36 of the corresponding cutting chamber 32. That is, the second outer wall 56 is inclined relative to the first outer wall 55 so that the first outer wall 55 becomes closer as the body 51 becomes farther. The third outer wall 57 is located on the blade 52 at a position that is farthest from the body 51 and is parallel to or substantially parallel to the corresponding cut portion 22 prior to cutting. The fourth outer wall 58 is parallel or substantially parallel to the fourth inner wall 38 of the corresponding cutting chamber 32. The fourth outer wall 58 of one of the blades 52 and the fourth outer wall 58 of the other blade 52 are faced away from each other in the widthwise direction of the cut portions 22.

The arc attenuation portion 60 projects toward the two cut portions 22 (recess 39) from between the blades 52 of the body 51. The arc attenuation portion 60 is in contact with the body 51 and the two blades 52. The arc attenuation portion 60 further projects toward the two cut portions 22 (recess 39) from the third outer wall 57 of each blade 52 in the thickness-wise direction of the cut portions 22. The arc attenuation portion 60 also further projects toward the opposite sides in the longitudinal direction of the cut portions 22 from the two blades 52. The arc attenuation portion 60 and the two blades 52 are integrated with the body 51.

The cutting member 50 is electrically insulative and formed from a material having high strength such as a resin material in the same manner as the case 30.

The breaker C of the first embodiment has the structure described above. The operation of the breaker C will now be described.

If the collision sensor 17 does not detect collision of the vehicle 10, an activation signal is not output from the electronic control unit 18 to the gas generator 45, and the gas G is not generated from the gas generator 45. Under this condition, as shown in FIGS. 1 and 3, each blade 52 of the cutting member 50 is located between the corresponding cut portion 22 and the gas generator 45 and separated from the corresponding cutting chamber 32. Thus, the two cut portions 22 are not cut, and the battery 12 and the converter 14 are electrically connected by the two conductors 20.

Figure 4:
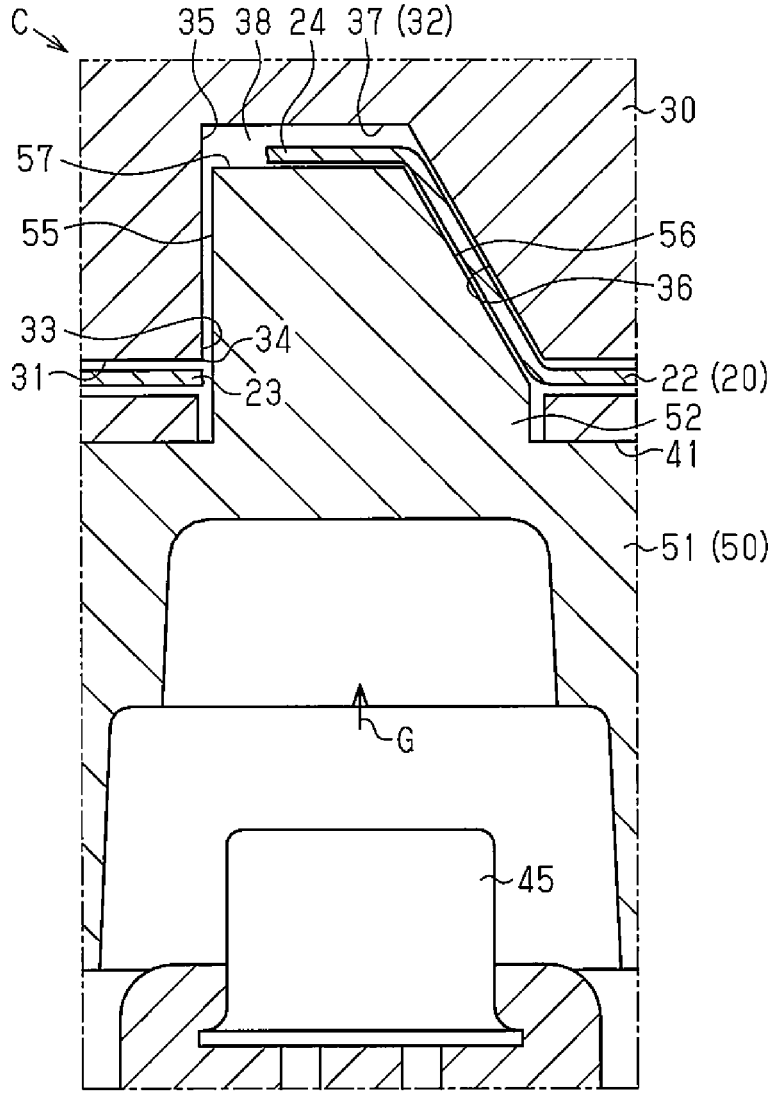
FIG. 4 is a partial cross-sectional view of a cut portion showing a conductor of FIG. 3 when cut.

If the collision sensor 17 detects collision of the vehicle 10 when the battery 12 and the converter 14 are electrically connected by the two conductors 20, an activation signal is output from the electronic control unit 18 to the gas generator 45. As shown in FIG. 4, the activation signal activates the gas generator 45 to generate the gas G. The cutting member 50 receives pressure of the gas G that flows toward the two cutting chambers 32. When the guide projections 53 move in the guide grooves 42 of the guide chamber 41, the cutting member 50 is guided and moved at a high speed. Each blade 52 moves toward the corresponding cutting chamber 32, and the arc attenuation portion 60 moves between the two cut portions 22, which are adjacent to each other.

As the cutting member 50 moves, each blade 52 comes into contact with the corresponding cut portion 22 simultaneously or substantially simultaneously and presses the cut portion 22 toward the corresponding cutting chamber 32.

The second inner wall 36 of each cutting chamber 32 may extend in the direction orthogonal to the corresponding cut portion 22 prior to cutting so that the cutting edge 34 is defined by each of the two longitudinal sides of the cutting chamber 32 in which the second outer wall 56 of each blade 52 extends in the direction orthogonal to the cut portion 22 prior to cutting. In such a case, when each blade 52 moves from the location close to the two cutting edges 34, each cut portion 22 would be cut at two locations in correspondence with the two cutting edges 34. Thus, compared to when each blade 52 cuts the cut portion 22 at a single location, the cutting member 50 would need to be moved toward the cutting chambers 32 with a load that is two time greater. Thus, a large load would need to be applied to the cutting member 50.

In the first embodiment, the second inner wall 36 of each cutting chamber 32 is inclined relative to the first inner wall 35 so that the first inner wall 35 becomes closer as the opening 33 becomes farther. Further, the second outer wall 56 of each blade 52 is inclined relative to the first outer wall 55 so that the first outer wall 55 becomes closer as the body 51 becomes farther.

Thus, when stress is applied to each cut portion 22 that is pressed toward the cutting chamber 32 by each blade 52 as described above, the stress concentrates at a part of the cut portion 22 that is close to the corresponding cutting edge 34. Accordingly, each cut portion 22 is cut between the cutting edge 34 and the first outer wall 55 of the corresponding blade 52. This forms the cutting ends 23 and 24, which are separated from each other, in each cut portion 22 as shown in FIG. 4. Further movement of the cutting member 50 after the cutting of the cut portions 22 moves each blade 52 further into the corresponding cutting chamber 32.

In this manner, in the first embodiment, the single cutting member 50, which is shared by the two cut portions 22, moves toward the two cutting chambers 32 so that each cut portion 22 is cut by the corresponding blade 52. That is, the two blades 52 are moved in the same direction to cut the two cut portions 22.

The cutting end 23 of each cut portion 22 is not pressed by the corresponding blade 52 and is thus located close to the cutting edge 34. A portion of each cut portion 22 that includes the cutting end 24 is pressed by the blade 52 and enters the cutting chamber 32. When pressed by the blade 52, the portion of each cut portion 22 that enters the cutting chamber 32 is bent at an obtuse angle along the inclined second outer wall 56 of the blade 52 and the inclined second inner wall 36 of the cutting chamber 32. The load for bending the cut portions 22 is smaller than that for cutting the cut portions 22. This reduces the load for moving the cutting member 50 toward the cutting chambers 32.

The cutting end 24 is located close to the third outer wall 57 of each blade 52. In other words, each cutting end 24 is located in a gap extending between the third inner wall 37 of the corresponding cutting chamber 32 and the third outer wall 57 of the blade 52 in the cutting chamber 32.

When each cut portion 22 is formed from copper, the cut portion 22 has high ductility and stretches when cut. This decreases the distance between the cutting ends 23 and 24 and arcs are apt to occur.

In the first embodiment, each conductor 20 is cut by the corresponding cutting edge 34 and the first outer wall 55 of the blade 52 that is moved relative to the cutting edge 34 over a slight distance D. Accordingly, as compared to when each cut portion 22 is cut only by pressing the blade 52 and without the cutting edge 34, the stretched amount of each cut portion 22 is small. This increases the distance between the cutting ends 23 and 24 and thus limits the generation of arcs.

When each cut portion 22 is divided at the cutting ends 23 and 24, the battery 12 and the converter 14 are electrically disconnected.

An arc may be generated when a potential difference occurs between the cutting ends 23 and 24 of one of the two adjacent cut portions 22 and the cutting ends 23 and 24 of the other cut portion 22. That is, a breakdown resulting in the flow of current may occur in the gas that exists between the cutting ends 23 and 24 of one cut portion 22 and the cutting ends 23 and 24 of the other cut portion 22.

A longer arc-flowing path is apt to attenuate the arc more easily. In this regard, in the breaker C of the first embodiment, the arc attenuation portion 60 is located between the two adjacent blades 52. That is, as shown in FIGS. 5, 6A, and 6B, the arc attenuation portion 60 is located between the cutting ends 23 and 24 of one cut portion 22 and the cutting ends 23 and 24 of the other cut portion 22.

An arc is apt to flow from the cutting ends 23 and 24 of one cut portion 22 toward the cutting ends 23 and 24 of the other cut portion 22 along the outer wall of the electrically insulative arc attenuation portion 60. As shown in FIGS. 5, 6A, and 6B, an arc flows in two paths, namely, path R1, in which an arc flows in the thickness-wise direction of the cut portion 22 along the outer wall of the arc attenuation portion 60, and path R2, in which an arc flows in the longitudinal direction of the cut portions 22 along the outer wall of the arc attenuation portion 60.

In the first embodiment, the arc attenuation portion 60 further projects toward the two cut portions (recess 39) from the two blades 52. Thus, the path R1 is longer than a breaker that does not include the arc attenuation portion 60 and a breaker in which the arc attenuation portion 60 does not further project toward the two cut portions 22 (recess 39) from the two blades 52.

Further, the arc attenuation portion 60 of the first embodiment further projects in the longitudinal direction of the cut portions 22 from the two blades 52. Thus, the path R2 is longer than a breaker that does not include the arc attenuation portion 60 and a breaker in which the arc attenuation portion 60 does not further project in the longitudinal direction of the cut portions 22 from the two blades 52. Longer arc-flowing paths R1 and R2 attenuate arcs more easily.

As a result, arcs have a smaller influence on the breaker C than a breaker that does not include the arc attenuation portion 60. For example, arcs are less likely to electrically connect the cutting end 23 of one of the cut portions 22 and the cutting end 23 of the other cut portion 22 or the cutting end 24 of one of the cut portions 22 and the cutting end 24 of the other cut portion 22. This limits situations in which the cutting ends 23 and 24 of one of the conductors 20 and the cutting ends 23 and 24 of the other conductor 20 are electrically connected even though the cutting ends 23 and 24 of one conductor 20 and the cutting ends 23 and 24 of the other conductor 20 are separated in the widthwise direction of the cut portions 22. Thus, softening and melting is limited in the two conductors 20 and resin members around the conductors 20 since high-temperature arcs do not occur.

The first embodiment has the advantages described below.

(1) The electric circuit 11 includes the battery 12 and the electric device 13 (two devices), and the breaker C is arranged between the battery 12 and the electric device 13 (refer to FIG. 2). The breaker C includes the two conductors 20, each including the elongated flat cut portion 22, the two cutting chambers 32, which are arranged in correspondence with the two cut portions 22, the gas generator 45, and the single cutting member 50 (refer to FIGS. 1 and 5). The two conductors 20 are arranged so that the two cut portions 22 are aligned in the widthwise direction of the cut portions 22. The cutting member 50 includes the same number of blades 52 as the cut portions 22, that is, two blades 52. In the breaker C, gas generated from the gas generator 45 moves the cutting member 50 toward the two cutting chambers 32 so that the two blades 52 cut the two cut portions 22. When each cut portion 22 is cut, the two cutting ends 23 and 24, which are separated from each other, are formed in each cut portion 22 (refer to FIG. 4). This electrically disconnects the battery 12 and the electric device 13.

In the breaker C, the arc attenuation portion 60, which is formed from an electrically insulative material, is located between the two adjacent cut portions 22 (refer to FIG. 7).

Thus, the arc attenuation portion 60 attenuates arcs that are generated between the cutting ends 23 and 24 of one of the two adjacent cut portions 22 and the cutting ends 23 and 24 of the other adjacent cut portion 22. In addition, the breaker C is reduced in size in the movement direction of the cutting member 50 compared to a breaker that moves the two cutting members in opposite directions between the two cut portions opposed in the thickness-wise direction (device disclosed in Japanese Laid-Open Patent Publication No. 2009-174846).

Since the single cutting member 50 attenuates arcs, the number of components is reduced in the breaker C.

(2) Since a longer arc-flowing path attenuates arcs more easily, the arc attenuation portion 60 is located between the two adjacent cut portions 22. Due to the arc attenuation portion 60, arcs flow along the paths R1 and R2 between the cutting ends 23 and 24 of one of the cut portions 22 and the cutting ends 23 and 24 of the other cut portion 22 (refer to FIGS. 5 and 6B). Thus, the paths R1 and R2 are longer than when the arc attenuation portion 60 is not included.

As a result, the breaker C attenuates arcs more greatly than a breaker that does not include the arc attenuation portion 60.

(3) The arc attenuation portion 60 includes the wall that is located between the two adjacent blades 52 and moved integrally with the two blades 52. The wall (arc attenuation portion 60) further projects toward the two cut portions 22 from the two blades 52 and further projects in the longitudinal direction of the cut portion 22 from the two blades 52 (refer to FIGS. 5, 6A, and 6B).

Thus, movement of the cutting member 50 moves the two blades 52 and the arc attenuation portion 60. This simplifies the structure of the breaker. When the cutting member 50 moves, the arc attenuation portion 60 moves into the recess 39 of the case 30. The arc-flowing path R1 is set to be longer than when the arc attenuation portion 60 does not further project toward the two cut portions 22 from the two blades 52. The arc-flowing path R2 is set to be longer than when the arc attenuation portion 60 does not further project in the longitudinal direction of the two cut portions 22 from the two blades 52. This attenuates arcs.

(4) The arc attenuation portion 60, the two blades 52, and the body 51 are formed integrally with each other so that the arc attenuation portion 60 contacts the two blades 52 and the body 51 (refer to FIG. 7).

In such a case, the arc attenuation portion 60 functions to couple the body 51 to the two blades 52. This increases the rigidity of the cutting member 50 as compared to when the arc attenuation portion 60 is not included such that a gap extends between the two blades 52.

Second Embodiment

Figure 8:
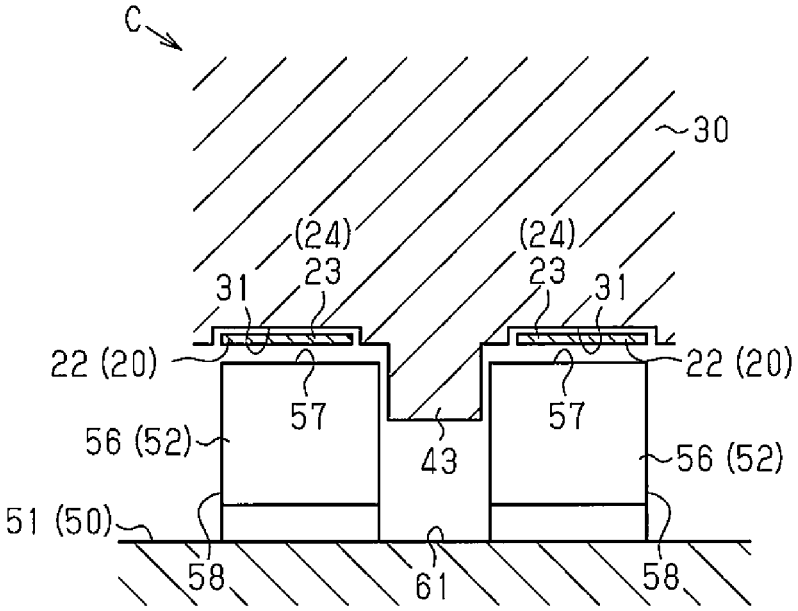
FIG. 8 is a cross-sectional view showing a second embodiment of a breaker, in which FIG. 8 corresponds to FIG. 6A.

A second embodiment of a breaker C will now be described with reference to FIG. 8.

The two blades 52 are required to function to cut the two cut portions 22 but the arc attenuation portion is not required to do so. Accordingly, the arc attenuation portion does not need to be integrated with the blades 52. Further, the arc attenuation portion may be formed by a component separate from the blades 52.

In this respect, the positional relationship of the arc attenuation portion and the recess of the second embodiment is reversed from that of the first embodiment. More specifically, a recess 61 is arranged between the adjacent blades 52 instead of the arc attenuation portion 60. That is, the cutting member 50 includes the recess 61 instead of the arc attenuation portion 60. The recess 61 corresponds to the recess 39 of the first embodiment and has the same function as the recess 39.

A wall projects toward the recess 61 of the cutting member 50 from the portion of the case 30 between the adjacent cutting chambers 32 (not shown). The wall defines an arc attenuation portion 43. Before the two cut portions 22 are cut by the two blades 52, the arc attenuation portion 43 partially enters the recess 61.

The structure of the second embodiment is otherwise the same structures as the first embodiment. To avoid redundancy, like or same reference numerals are given to those components that are the same as the corresponding components of the first embodiment and thus will not be described.

In the breaker C of the second embodiment having the above structure, when the cutting member 50 moves toward the two cutting chambers 32 (toward the upper side in FIG. 8), the arc attenuation portion 43 of the case 30 further enters the recess 61 of the cutting member 50.

Each cut portion 22 is pressed by the corresponding blade 52 and cut in the corresponding cutting chamber 32. Each cut portion 22 is cut to form the two cutting ends 23 and 24 that are separated from each other. Each conductor 20 is divided at the cutting ends 23 and 24. The arc attenuation portion 43 is located between the cutting ends 23 and 24 of one of the cut portions 22 and the cutting ends 23 and 24 of the other cut portion 22.

An arc flows from the cutting ends 23 and 24 of one cut portion 22 toward the cutting ends 23 and 24 of the other cut portion 22 along the outer wall of the arc attenuation portion 43, which is electrically insulative. The arc-flowing path is longer than when the arc attenuation portion 43 is not located between the adjacent blades 52.

Accordingly, in addition to advantages (1) and (2), the second embodiment has the advantage described below instead of advantage (3).

(5) The arc attenuation portion 43 includes the wall that projects from between the two adjacent cutting chambers 32 and enters the recess 61 that is located between the two adjacent blades 52.

The arc attenuation portion 43 lengthens the arc-flowing path and attenuates arcs.

Third Embodiment

Figure 9:
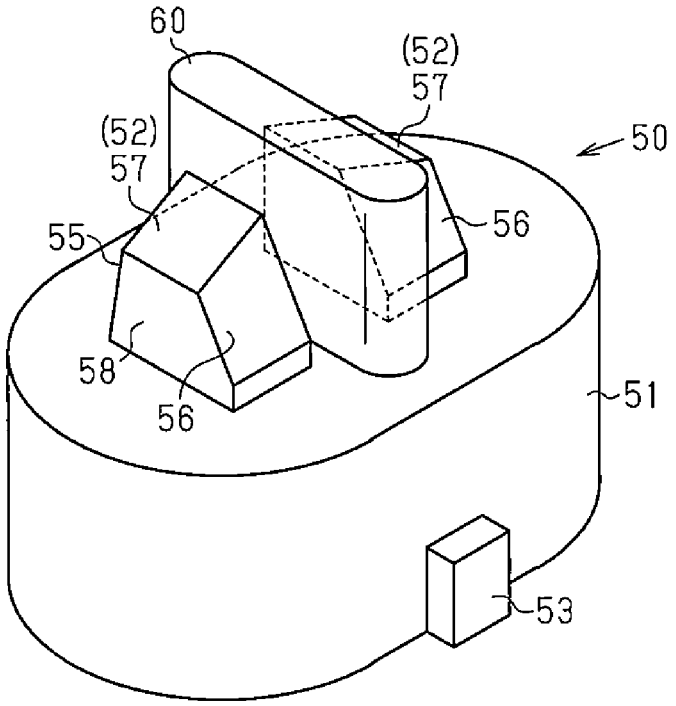
FIG. 9 is a perspective view showing a cutting member in a third embodiment of a breaker.
Figure 10:
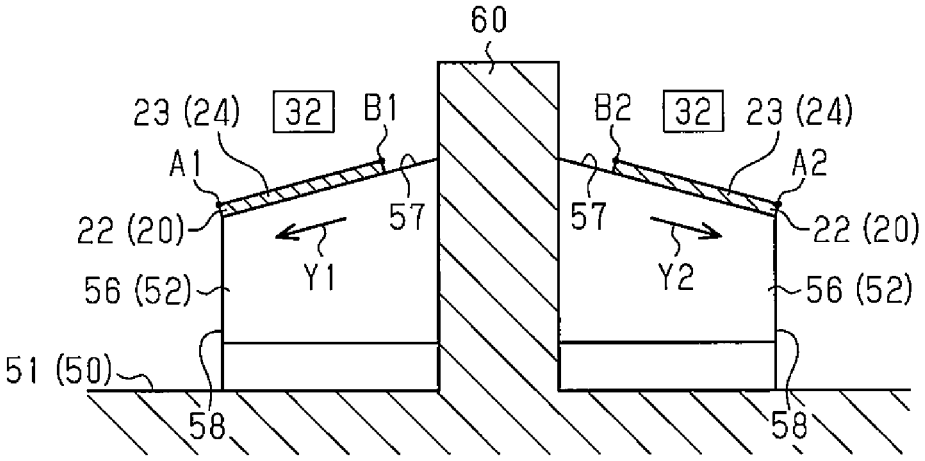
FIG. 10 is a partial cross-sectional view showing the relationship of the cutting member and two cut portions in the breaker of FIG. 9.

A third embodiment of a breaker C will now be described with reference to FIGS. 9 and 10.

In the same manner as the first embodiment, the third outer wall 57 of each blade 52 in the third embodiment is closest to the corresponding cutting chamber 32. Each third outer wall 57 of the first embodiment is parallel to the cut portions 22 prior to cutting as shown in FIG. 6A. However, each third outer wall 57 of the third embodiment is inclined to be farther from the cutting chambers 32 as the corresponding blade 52 becomes farther as shown in FIGS. 9 and 10. That is, the third outer wall 57 of one of the blades 52 and the third outer wall 57 of the other blade 52 are inclined away from each other in opposite directions.

Otherwise, the third embodiment has the same structures as the first embodiment. To avoid redundancy, like or same reference numerals are given to those components that are the same as the corresponding components of the first embodiment and thus will not be described.

In the breaker C of the third embodiment having such a structure, when the cutting member 50 moves toward the two cutting chambers 32, each cut portion 22 is pressed by the inclined third outer wall 57 of the corresponding blade 52. The third outer wall 57 of each blade 52 of the third embodiment is inclined to be farther from the corresponding cutting chamber 32 as the adjacent blade 52 becomes farther.

In other words, the third outer wall 57 of each blade 52 is inclined to be farther from the corresponding cut portion 22 as the adjacent blade 52 becomes farther. Thus, as the cutting member 50 moves, the portion of each cut portion 22 that is pressed by the third outer wall 57 of the corresponding blade 52 changes from a portion that is close to the adjacent cut portion 22 to a portion that is far from the adjacent cut portion 22. The two adjacent cut portions 22 are accordingly cut from the portion that is close to the adjacent cut portion 22 toward the portion that is far from the adjacent cut portion 22 as shown by arrows Y1 and Y2 in FIG. 10. In other words, each cut portion 22 is cut from a portion that is close to the arc attenuation portion 60 in the widthwise direction toward a portion that is far from the arc attenuation portion 60. When cut, the two cut portions 22 are twisted along the third outer walls 57 where the two blades 52 are inclined. When the part of each cut portion 22 farthest from the adjacent cut portion 22 is cut, the cut portion 22 is divided to form the cutting ends 23 and 24 that are separated from each other. The cutting ends 23 and 24 are inclined along the third outer wall 57 to which the corresponding blade 52 is inclined.

In such a case, an arc are generated between a portion A1 of the cutting end 23 of one of the cut portions 22 (left in FIG. 10) that is farthest from the adjacent cut portion 22 and a portion A2 of the cutting end 23 of the other cut portion 22 (right in FIG. 10) that is farthest from the adjacent cut portion 22. Further, an arc is generated between the portion A1 of the cutting end 24 of one of the cut portions 22 (left in FIG. 10) that is farthest from the adjacent cut portion 22 and the portion A2 of the cutting end 24 of the other cut portion 22 (right in FIG. 10) that is farthest from the adjacent cut portion 22.

When the cutting ends 23 and 24 are not inclined in this manner, an arc would be generated between a portion B1 of the cutting end 23 of one of the cut portions 22 that is closest to the adjacent cut portion 22 and a portion B2 of the cutting end 23 of the other cut portion 22 that is closest to the adjacent cut portion 22. Further, an arc would be generated between the portion B1 of the cutting end 24 of one of the cut portions 22 that is closest to the adjacent cut portion 22 and the portion B2 of the cutting end 24 of the other cut portion 22 that is closest to the adjacent cut portion 22.

Thus, the length of the arc-flowing path in the breaker C of the third embodiment is increased by the total width of the two cut portions 22 than when the cutting ends 23 and 24 are not inclined as described in the first embodiment.

Accordingly, in addition to advantages (1) to (4), the third embodiment has the advantage described below.

(6) The third outer wall 57 that is closest to the cutting chamber 32 is inclined to be farther from the cutting chamber 32 as the adjacent blade 52 becomes farther.

Thus, the arc-flowing path is longer than when each third outer wall 57 is not inclined, that is, when each third outer wall 57 is parallel to the cut portions 22 prior to cutting. This further attenuates arcs.

It should be apparent to those skilled in the art that the present invention may be embodied in many other specific forms without departing from the spirit or scope of the invention. Particularly, it should be understood that the present invention may be embodied in the following forms.

The inclined third outer wall 57 of the third embodiment is applicable to the second embodiment.

Figure 11:
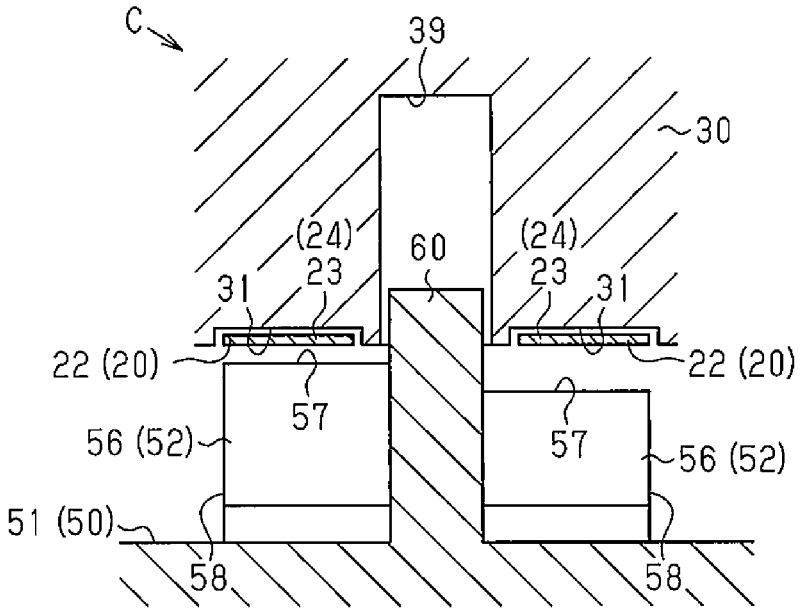
FIG. 11 is a cross-sectional view showing a modified example of a breaker, in which FIG. 11 corresponds to FIG. 6A.

As shown in FIG. 11, when the two cut portions 22 are aligned in the widthwise direction of the cut portions 22 along the same plane in the breaker C, the two adjacent blades 52 of the cutting member 50 may be offset from each other in the moving direction (vertical direction in FIG. 11) of the cutting member 50.

In such a case, when the two conductors 20 are electrically connected and the cutting member 50 is moved by gas toward the cutting chambers 32 (not shown), that is, toward the upper side in FIG. 11, the blade 52 that is closer to the corresponding cutting chamber 32 (left blade 52 in FIG. 11) presses and cuts the corresponding cut portion 22 in the cutting chamber 32. After the cut portion 22 is cut, the other cut portion 22 prior to cutting is pressed and cut by the other blade 52 (right blade 52 in FIG. 11) that is far from the corresponding cutting chamber 32 in the cutting chamber 32. In this manner, the adjacent cut portions 22 are pressed and cut at different timings. This allows the two cut portions 22 to be cut with a smaller load than when the adjacent cut portions 22 are cut simultaneously.

Such a structure is applicable to the second and third embodiments as well as the first embodiment. Further, such a structure is applicable to an embodiment in which the second and third embodiments are combined.

In each of the above embodiments, the arc attenuation portion 60 does not have to further project toward the two cut portions 22 from the two blades 52. Instead, the arc attenuation portion 60 may further project only in the longitudinal direction of the cut portions 22 from the two blades 52.

Further, the arc attenuation portion 60 does not have to further project in the longitudinal direction of the cut portions 22 from the two blades 52. Instead, the arc attenuation portion 60 may further project only toward the two cut portions 22 from the two blades 52.

The arc attenuation portion 60 that further projects in the longitudinal direction of the cut portions 22 from the two blades 52 does not necessarily have to further project toward opposite sides in the longitudinal direction from the two blades 52. That is, the arc attenuation portion 60 needs to further project from the two blades 52 toward at least the side where the cutting ends 23 and 24 are located (left side in FIG. 5).

Thus, although the arc attenuation portion 60 may further project toward the two sides in the longitudinal direction of the cut portions 22 from the two blades 52 as described in each of the above embodiments, the arc attenuation portion 60 need to only further project from the two blades 52 toward the side where the cutting ends 23 and 24 are located (left side in FIG. 5).

In the first and third embodiments, the arc attenuation portion 60 may be separated from at least one of the two blades 52 as long as the arc attenuation portion 60 is located between the two blades 52.

In each of the above embodiments, a resin material is used for the case 30 and the cutting member 50. Instead, any material may be used as long as it is electrically insulative and has a high strength that allows the cut portions 22 to be cut.

In each of the above embodiments, the case 30 and the cutting member 50 may be formed by any methods such as metal molding and metal cutting.

The above breaker C is applicable to a breaker C that uses the single cutting member 50 to cut and electrically disconnect each cut portion 22 of three or more conductors 20. In such a case, the number of the blades 52 in the cutting member 50 is the same as the number of cut portions 22.

The above breaker C does not have to be located between the battery 12 and the converter 14 and may be located between other devices of an electric circuit to electrically disconnect the devices. Such a breaker may be used, for example, in a fuel cell vehicle between a fuel cell and a vehicle motor, in a stationary system arranged between a power supply and an electric device, or a stationary system between electric devices.

The invention claimed is:

1. A breaker that electrically disconnects two devices of an electric circuit, the breaker comprising:

a plurality of conductors, each including an elongated flat cut portion, wherein the conductors are located between the devices, the cut portions are aligned in a widthwise direction of the cut portions, and each of the cut portions is cut to form two separated cutting ends and electrically disconnect the devices;

cutting chambers respectively arranged in correspondence with the cut portions, wherein the cutting chambers are each located at one side of the corresponding cut portion in a thickness-wise direction of the cut portion;

a gas generator located at a side of the cut portions opposite to the cutting chambers;

a single cutting member located between the cut portions and the gas generator, wherein the cutting member includes blades, the number of which is the same as the cut portions, and the gas generator generates gas that moves the cutting member to cut the cut portions with the blades in the cutting chambers; and an arc attenuation portion located between the two cut portions that are adjacent to each other, wherein the arc attenuation portion is formed from an electrically insulative material, and the arc attenuation portion attenuates an arc generated between the two cutting ends of one of the two adjacent cut portions and the two cutting ends of the other cut portion, wherein the arc attenuation portion attenuates the arc by setting a longer path in which the arc flows from the two cutting ends of one cut portion to the two cutting ends of the other cut portion than when the arc attenuation portion is omitted, the blades include two adjacent blades that cut the two adjacent cut portions, and the arc attenuation portion includes a wall that is located between the two adjacent blades and moved integrally with the two blades.

2. The breaker according to claim 1, wherein the wall further projects toward the two adjacent cut portions from the two adjacent blades.

3. The breaker according to claim 1, wherein the wall further projects in a longitudinal direction of the cut portions from the two adjacent blades.

4. The breaker according to claim 1, wherein the two adjacent cut portions are aligned with each other to be coplanar, and the two adjacent blades are offset from each other in a direction in which the cutting member moves.

5. A breaker that electrically disconnects two devices of an electric circuit, the breaker comprising:

a plurality of conductors, each including an elongated flat cut portion, wherein the conductors are located between the devices, the cut portions are aligned in a widthwise direction of the cut portions, and each of the cut portions is cut to form two separated cutting ends and electrically disconnect the devices;

cutting chambers respectively arranged in correspondence with the cut portions, wherein the cutting chambers are each located at one side of the corresponding cut portion in a thickness-wise direction of the cut portion;

a gas generator located at a side of the cut portions opposite to the cutting chambers;

a single cutting member located between the cut portions and the gas generator, wherein the cutting member includes blades, the number of which is the same as the cut portions, and the gas generator generates gas that moves the cutting member to cut the cut portions with the blades in the cutting chambers; and an arc attenuation portion located between the two cut portions that are adjacent to each other, wherein the arc attenuation portion is formed from an electrically insulative material, and the arc attenuation portion attenuates an arc generated between the two cutting ends of one of the two adjacent cut portions and the two cutting ends of the other cut portion, wherein the blades include two adjacent blades that cut the two adjacent cut portions, the cutting chambers include two adjacent cutting chambers in which the two adjacent cut portions are cut, and the arc attenuation portion includes a wall that projects from between the two adjacent cutting chambers, wherein the wall is configured to move into between the two adjacent blades.

6. The breaker according to claim 5, wherein the two adjacent cut portions are aligned with each other to be coplanar, and the two adjacent blades are offset from each other in a direction in which the cutting member moves.

7. A breaker that electrically disconnects two devices of an electric circuit, the breaker comprising:

a plurality of conductors, each including an elongated flat cut portion, wherein the conductors are located between the devices, the cut portions are aligned in a widthwise direction of the cut portions, and each of the cut portions is cut to form two separated cutting ends and electrically disconnect the devices;

cutting chambers respectively arranged in correspondence with the cut portions, wherein the cutting chambers are each located at one side of the corresponding cut portion in a thickness-wise direction of the cut portion;

a gas generator located at a side of the cut portions opposite to the cutting chambers;

a single cutting member located between the cut portions and the gas generator, wherein the cutting member includes blades, the number of which is the same as the cut portions, and the gas generator generates gas that moves the cutting member to cut the cut portions with the blades in the cutting chambers; and an arc attenuation portion located between the two cut portions that are adjacent to each other, wherein the arc attenuation portion is formed from an electrically insulative material, and the arc attenuation portion attenuates an arc generated between the two cutting ends of one of the two adjacent cut portions and the two cutting ends of the other cut portion, wherein the blades each include outer walls, and one of the outer walls of each blade that is closest to the corresponding cutting chamber is inclined to be farther from the cutting chamber as the adjacent blade becomes more distant.

* * * * *